US009163867B2

(12) United States Patent
Culley

(10) Patent No.: US 9,163,867 B2
(45) Date of Patent: Oct. 20, 2015

(54) ICE CUBE SHAPE MANIPULATION VIA HEAT

(71) Applicant: Whirlpool Corporation, Benton Harbor, MI (US)

(72) Inventor: Brian K. Culley, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 363 days.

(21) Appl. No.: 13/714,838

(22) Filed: Dec. 14, 2012

(65) Prior Publication Data

US 2014/0165615 A1 Jun. 19, 2014

(51) Int. Cl.
*F25C 1/00* (2006.01)
*F25C 1/04* (2006.01)

(52) U.S. Cl.
CPC ..... *F25C 1/04* (2013.01); *F25C 2500/02* (2013.01)

(58) Field of Classification Search
CPC ..... F25C 1/00; F25C 1/04; F25C 1/12; F25C 1/225; F25C 5/005; F25C 5/08
USPC ..... 62/66, 340, 347, 348, 352
See application file for complete search history.

(56) References Cited

U.S. PATENT DOCUMENTS

| | | | | |
|---|---|---|---|---|
| 2,221,694 | A * | 11/1940 | Potter | 62/138 |
| 3,318,105 | A | 5/1967 | Burroughs | |
| 3,861,163 | A | 1/1975 | Carpenter | |
| 4,412,429 | A | 11/1983 | Kohl | |
| 4,990,169 | A | 2/1991 | Broadbent | |
| 5,182,925 | A * | 2/1993 | Alvarez et al. | 62/347 |
| 5,431,024 | A | 7/1995 | Hobelsberger | |
| 6,935,124 | B2 | 8/2005 | Takahashi et al. | |
| 6,951,113 | B1 | 10/2005 | Adamski | |
| 7,201,015 | B2 * | 4/2007 | Feldman et al. | 62/347 |
| 7,487,645 | B2 | 2/2009 | Sasaki et al. | |
| 7,703,300 | B2 | 4/2010 | Petrenko | |
| 2005/0072167 | A1 * | 4/2005 | Oh | 62/137 |
| 2008/0190125 | A1 * | 8/2008 | Yoshioka et al. | 62/208 |
| 2009/0031750 | A1 * | 2/2009 | Whillock, Sr. | 62/344 |

FOREIGN PATENT DOCUMENTS

| | | | |
|---|---|---|---|
| JP | 4013071 | A | 1/1992 |
| JP | 2001041621 | A | 2/2001 |

* cited by examiner

*Primary Examiner* — Melvin Jones

(57) ABSTRACT

An ice making device includes heating and cooling elements that control the formation of ice within a cavity. The ice making device may include one or more fluid inlets that supply liquid water to the cavity, and one or more fluid outlets that drain water from the cavity after formation of ice having a desired shape.

15 Claims, 6 Drawing Sheets

ICE CUBE SHAPE MANIPULATION VIA HEAT

BACKGROUND OF THE INVENTION

Ice cubes may be formed by filling the cavities of a tray with liquid water, and the ice cube tray is then placed in a freezer to thereby cause the liquid water to freeze into the shape of the cavities of the ice tray. Ice cubes formed in this matter typically have lower and side surfaces having a shape closely corresponding to the shape of the cavities of the ice tray. The upper surface of the water is generally flat due the effects of gravity, and the resultant upper surface of the ice cube is also therefore generally flat. Various other types of ice making devices have also been developed. However, known ice making devices may suffer from various drawbacks.

SUMMARY OF THE INVENTION

One aspect of the present invention is an ice making apparatus including a cavity that receives liquid water therein. Liquid water is introduced into the cavity, and a portion of the cavity is cooled to cause at least some of the ice in the cavity to freeze. Other portions of the cavity may be heated to thereby prevent formation of ice in selected locations or regions of the cavity. In this way, the shape of the ice forming in the cavity can be controlled to produce a piece of ice having a specific shape that is different than the shape of the cavity.

The cavity may have side walls, a bottom wall, and a top wall. A plurality of individual heating elements may be disposed in the side walls, and a lower side wall of the cavity may be cooled by a thermoelectric element or other cooling arrangement. The cavity may have an upper side wall having a lower surface facing the cavity. A mold cavity may be formed in a lower surface of the upper side wall to thereby form a predetermined shape in the ice formed at the top of the cavity. The upper side wall may comprise metal or other thermally conductive material, and the upper side wall may be heated to control freezing of water in the vicinity of the mold cavity. The individual heating elements disposed in the sidewalls may be individually controlled to thereby provide heat at selected locations of the sidewalls. The heat introduced by the individual heating elements can be utilized to control the formation of ice within the cavity to thereby cause the ice forming in the cavity to take on a predefined shape. The controller may be preprogrammed to actuate the individual heating elements in predetermined combinations to thereby cause the water to freeze into a specific predefined shape. In this way, the same cavity may be utilized to form pieces of ice having different shapes.

One or more fluid inlet lines may be fluidly connected to the cavity to thereby introduce liquid water into the cavity. One or more fluid drain lines may also be fluidly connected to the cavity. In use, the fluid drain lines drain excess liquid water from the cavity after the water in the cavity has frozen sufficiently to form the desired shape.

These and other features, advantages, and objects of the present invention will be further understood and appreciated by those skilled in the art by reference to the following specification, claims, and appended drawings.

DETAILED DESCRIPTION

Figure 1:
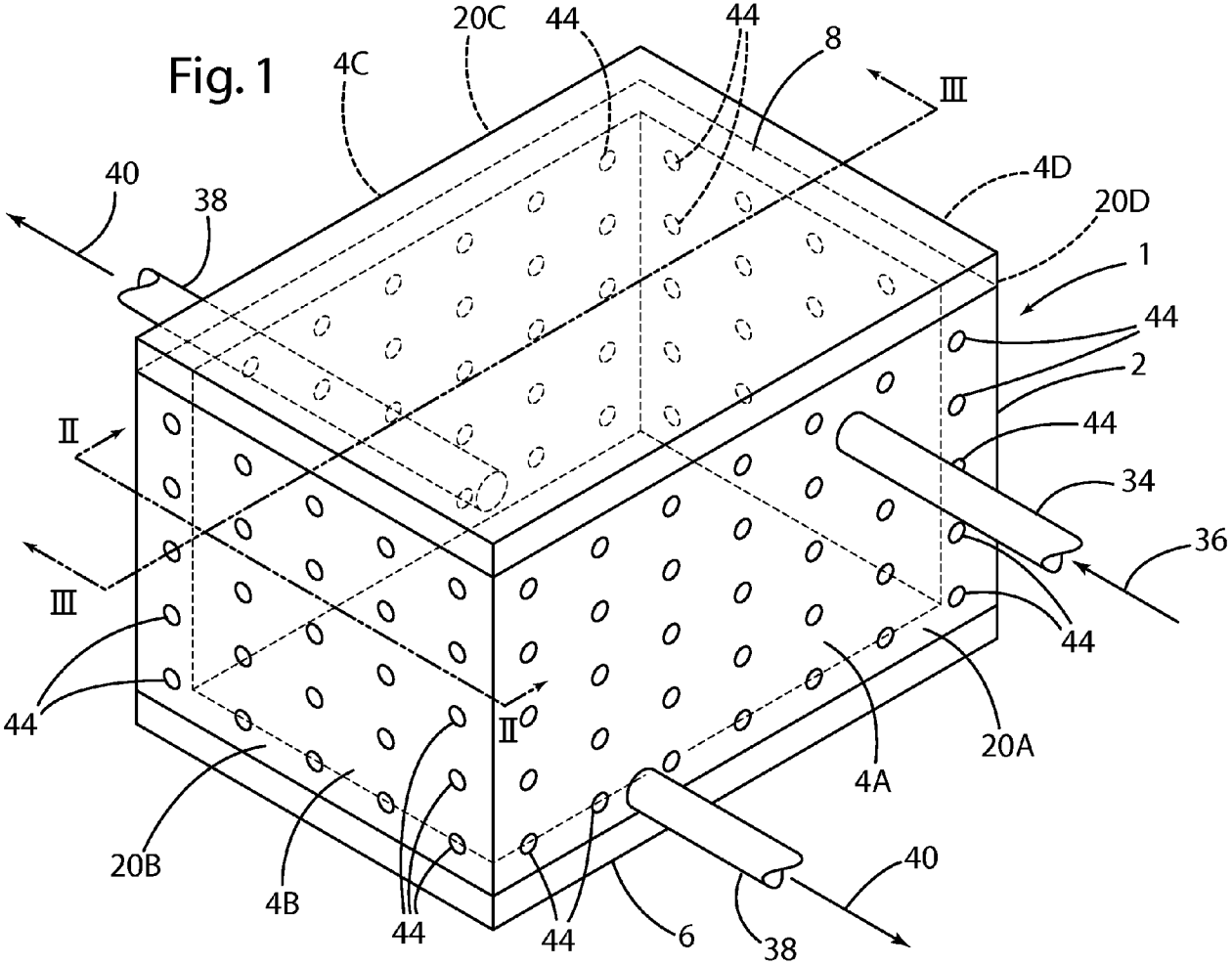
FIG. 1 is an isometric view of an ice making device according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
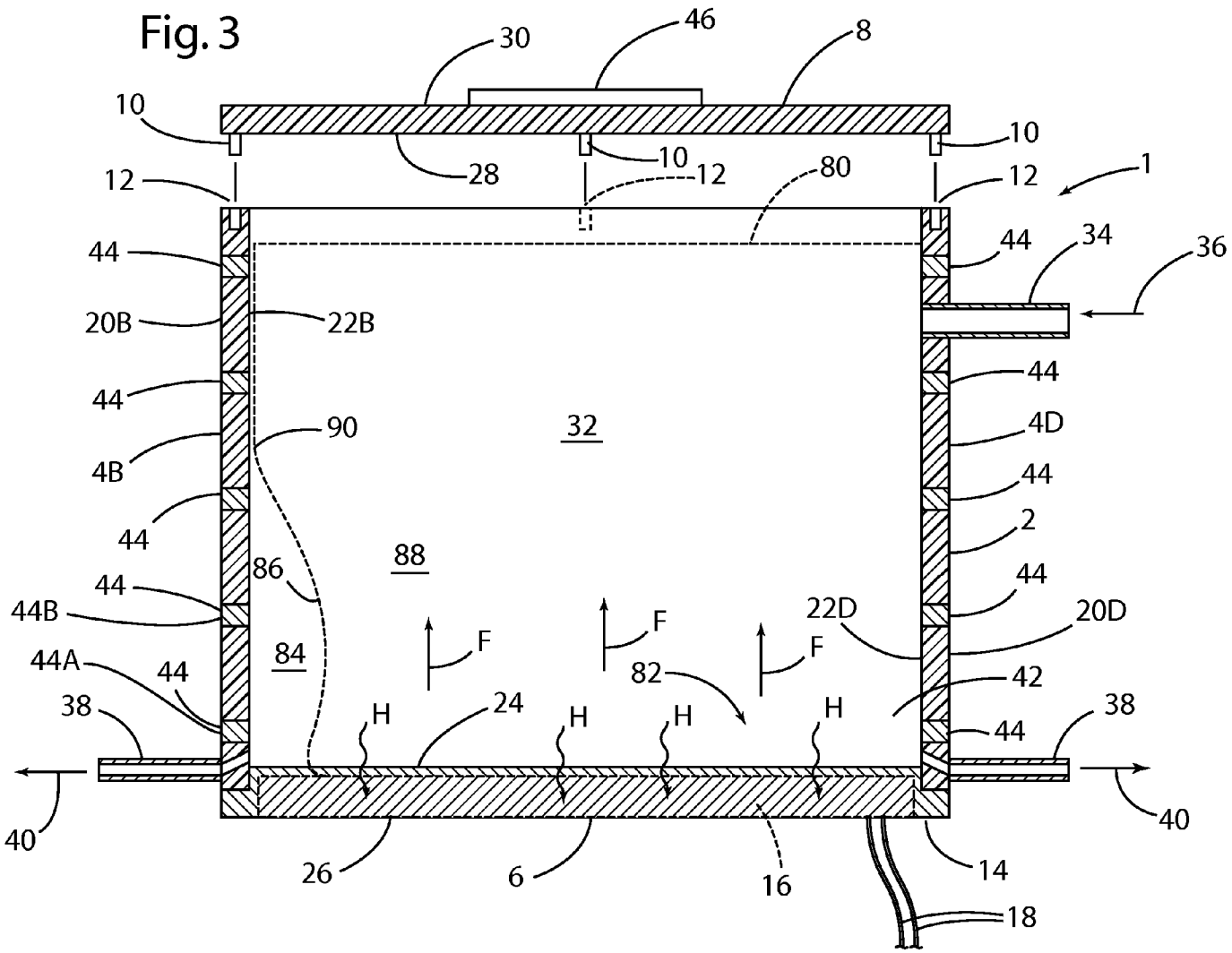
FIG. 3 is a cross sectional view of the device of FIG. 1 taken along the line III-III.
Figure 6:
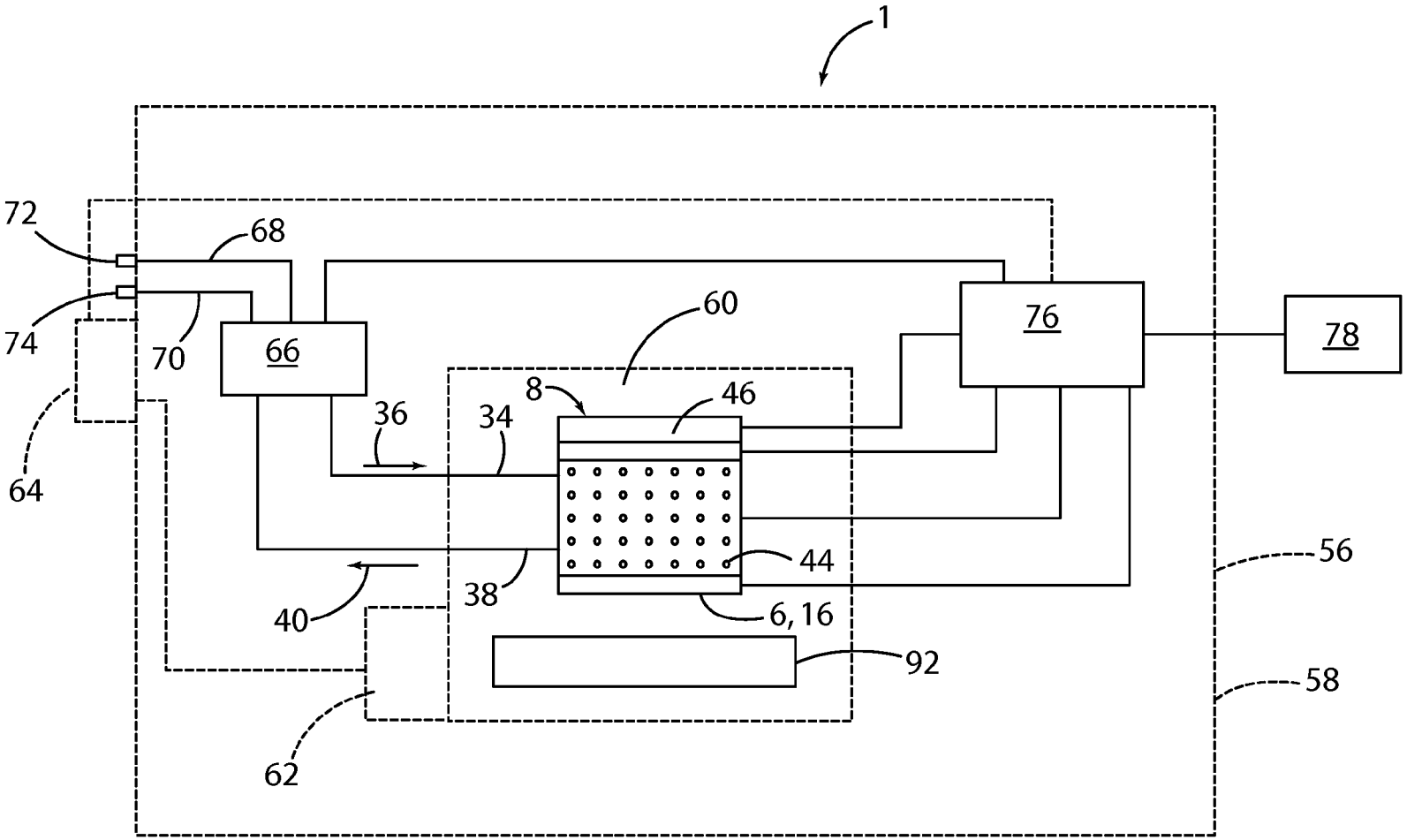
FIG. 6 is a schematic view of an ice making system including the device of FIG. 1.

With reference to FIG. 1, an ice making device 1 according to one aspect of the present disclosure includes a container structure 2 including generally upright side walls 4A-4D, and a generally horizontal lower wall 6 forming a cavity 32. An openable cover 8 is positioned on the container structure 2. Cover 8 may be movably connected to container structure 2 by hinges (not shown) or other suitable arrangement. Alternately, cover 8 may be removable. If removable, cover 8 may be positioned utilizing connectors or alignment features such as pins 10 that are received in openings 12 (FIG. 3). A powered actuator (not shown) may be operably connected to cover 8 such that cover 8 can be shifted to an open position by controller 76 (FIG. 6). The side walls 4A-4D may be made from a polymer material or other material having relatively low thermal conductivity. The lower wall 6 may include a primary structure 14 that may be made of metal (e.g. stainless steel or aluminum) or other heat conducting material. The lower wall 6 may also include a cooling element 16. The cooling element 16 may comprise a thermoelectric device that is connected to a power source 64 (FIG. 6) by electrical lines 18. Cooling element 16 may also comprise a thermally conductive element that is thermally coupled to a known refrigeration system of the type having a compressor, a condenser, and an evaporator.

Side walls 4A-4D include outer surfaces 20A-20D, respectively, and inner surfaces 22A-22D, respectively. Lower wall 6 includes an inner surface 24, and an outer side 26. Cover 8 includes an inner surface 28, and an outer surface 30. The inner surfaces 22A-22D of side walls 4A-4D, respectively and inner surface 24 of lower wall 6 define cavity 32. In the illustrated example, the inner surfaces 22A-22D are substantially planar. However, the surfaces 22A-22D may be curved, sloped, etc. as required for a particular application. Thus, a cavity 32 could comprise almost any shape. For example, cavity 32 could comprise a spherical shape, a truncated pyramid, or variations thereof. Similarly, inner surface 24 of lower walls 6 may be planar as shown, or it may be non-planar (e.g. curved). The volume of cavity 32 is preferably about 10 ml-100 ml, but the volume could be outside this range if required for a particular application. A fluid conduit 34 provides for entry of liquid water 36 into cavity 32. A single fluid conduit 34 is shown in FIGS. 1 and 3. However, it will be understood that each of the side walls 4 may include a fluid conduit 34 to provide for flow of liquid water 36 into cavity 32. Also, a fluid conduit 34 may extend through cover 8 to provide liquid water to cavity 32. One or more fluid conduits 38 are fluidly connected to a lower portion 42 of cavity 32 to provide for draining of water from cavity 32 that has not frozen. Each side wall 4A-4D may include a fluid drain conduit 38. The lower wall 6 may also include a fluid drain conduit 38.

Figure 4:
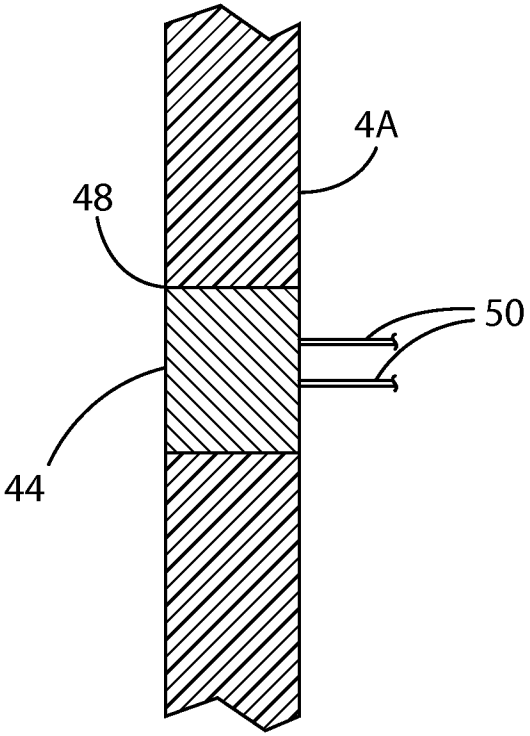
FIG. 4 is a fragmentary, enlarged view of a portion of the device of FIG. 2.

With reference to FIGS. 1 and 4, a plurality of electrical heating elements 44 are disposed in each side wall 4A-4D. In the illustrated example, side walls 4A and 4C each include five rows of electric heating elements 44, wherein each row has seven electric heating elements 44. In the illustrated example, the side walls 4B and 4D have five rows of electric heating elements 44, wherein each row includes five electric heating elements 44. However, more or fewer electrical heating elements 44 could be utilized. For example, each sidewall 4A-4D could include a single electrical heating element 44. Furthermore, one or more sidewalls 4A-4D could be constructed without any heating element 44. The capacity of electrical heating elements 44 may vary depending upon the requirements of a particular application. In general, if cavity 32 has a volume in the range of about 10 ml-100 ml, each sidewall 4A-4D may have electric heating elements 44 providing a total of at least about 2-4 watts per side wall 4A-4D. However, greater capacity may be utilized if required for a particular application. Referring again to FIG. 4, electric heating elements 44 may be substantially cylindrical, and may be disposed in cylindrical bores 48 through side walls 4A-4D. The heating elements 44 may be secured in bores 48 utilizing sealants or adhesives to provide a water tight fit. The heat-generating capacity of the heating elements 44 may be selected according to the requirements of a particular application. Electrical lines 50 provide electrical power to the heating elements 44. As discussed in more detail below, each electric heating element 44 (and 46) may be separately connected to a controller, 76 (FIG. 6) such that specific heating elements 44 can be actuated to produce heat, while other heating elements 44 may remain deactivated. Individual heating elements 44 can be activated and deactivated at different times, and the amount of electrical power supplied to each individual electrical heating element 44 can also be controlled. In this way, the total amount of heat supplied to cavity 32 can be precisely controlled. Also, the distribution of the heat being supplied to liquid water in cavity 32 at specific times can also be precisely controlled.

The cover 8 (FIG. 3) may be made of a thermally non-conductive material, and may include a plurality of heating elements 44 distributed in a substantially similar manner to the heating elements 44 in side walls 4A-4D. Alternately, cover 8 may comprise a thermally conductive material (e.g. metal), and a single heating element 46 may be thermally coupled to cover 8 to provide for substantially even heating of cover 8.

Figure 5:
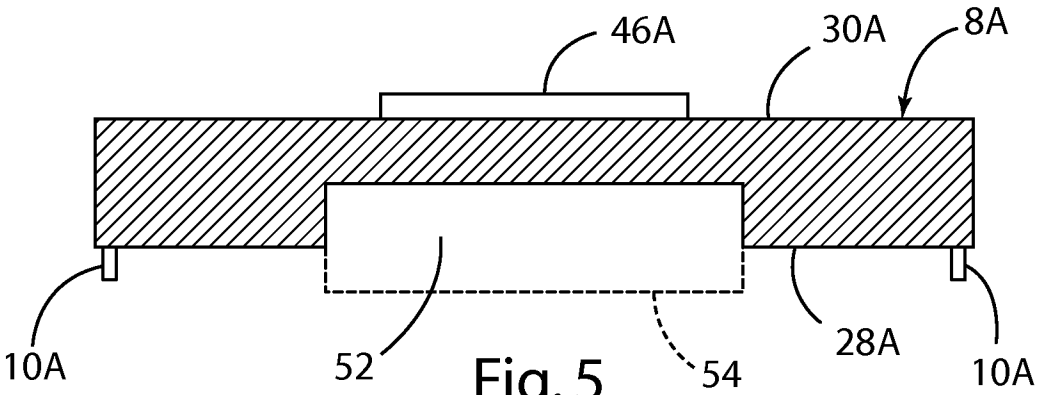
FIG. 5 is a cross sectional view of a top plate having a mold cavity that may be utilized in the device of FIG. 1.

With further reference to FIG. 5, a cover 8A according to another aspect of the present invention includes a downwardly facing mold cavity 52 formed in inner or lower side surface 28 of cover 8A. Cover 8A is preferably made of a thermally conductive material (e.g. stainless steel or aluminum) that is also corrosion resistant. An electric heating element 46A provides heat to cover 8A. As discussed in more detail below, cover 8A may be selectively heated utilizing heating element 46A to thereby cause liquid water in cavity 32 to freeze and expand upwardly into mold cavity 52 to thereby provide a specific shape corresponding to the shape of mold cavity 52. In the illustrated example, the mold cavity 52 is generally concave to thereby produce a convex or protruding design or pattern on an upper surface of ice freezing in cavity 32. In general, cavity 52 may have a concave dome shape, a star shape, or other decorative shape. However, mold cavity 52 could also comprise a projection 54 that protrudes downwardly from inner surface 28 of cover 8A. Projection 54 causes ice forming in cavity 32 to have a concave upper surface portion.

As discussed below, ice initially forms adjacent lower wall 6, and freezing generally travels upwardly towards cover 8. In general, the volume of the water tends to increase as the water freezes, and the upper surface 80 (FIG. 3) thereby tends to move upwardly as the water freezes. The heating element 46A in cover 8A may be selectively actuated to cause the freezing water to fill mold cavity 52 as it freezes. In this way, a protrusion may be formed on the ice having a specific desired shape corresponding to the shape of mold cavity 52. Individual heating elements 44 adjacent upper surface 80 of the water may also be selectively actuated to control the shape of surface 80 as the water freezes into ice.

With further reference to FIG. 6, ice making device 1 may comprise part of a freezer 56 having a cabinet 58, and a freezer compartment 60. A cooling system 62 may be utilized to maintain the freezer compartment 60 at a temperature near or below the freezing temperature of water. The refrigeration system 62 may comprise a known thermoelectric cooling system, or it may comprise a known cooling system including a compressor, evaporator, and a condenser. The refrigeration system 62 may be operably connected to a power supply 64. The power supply 64 may include conventional power lines and plugs (not shown) to electrically connect the freezer 56 to a conventional electrical wall outlet.

A water circulation system 66 includes fluid conduits 68 and 70 that are fluidly connected to external connectors 72 and 74. Fluid conduit 68 comprises an inlet line that receives liquid water, and fluid conduit 70 comprises a drain line that provides for exit of excess liquid water. The water circulation system 66 provides liquid water 36 to inlet conduits 34 to thereby selectively fill cavity 32 of container structure 2. The fluid circulation system 66 is also fluidly connected to fluid conduit 38 to thereby drain water 40 from cavity 32 of container structure 2.

A controller 76 is operably connected to the water circulation system 66. Water circulation system 66 may include one or more electrically actuated pumps and/or valves (not shown) and other fluid control components whereby controller 76 can control the water flowing into cavity 34 of container 2 through conduit 36, and the fluid exiting cavity 32 through fluid conduit 38. For example, controller 76 may be configured to actuate water circulation system 66 to cause specific volumes of water to flow into cavity 34 at specific times.

Controller 76 is also operably connected to electrical heating elements 44 in side walls 4A-4D, and to cooling element 16 in lower wall 6. Controller 76 is also operably connected to heating element 46 (or elements 44) in cover 8. Controller 76 is configured to individually actuate/control each heating element 44 such that each heating element 44 can be individually turned on/off, and the amount of heat produced by each heating electrical heating element 44 can also be controlled. Controller 76 is also configured to individually control heating element 46 of cover 8 and cooling element 16 of lower wall 6. If cover 8 includes individual heating elements 44, the heating elements 44 of cover 8 may also be independently controlled by controller 76. Controller 76 is also operably connected to a user interface 78. User interface 78 may comprise a display screen (not shown), push buttons, a touch screen, and other user interface features that allow a user to input instructions to controller 76.

In use, liquid water is introduced into cavity 32 by controller 76 utilizing fluid conduits 34 (FIG. 3). A predetermined amount of water is introduced into cavity 32, and the liquid water thereby forms an upper surface 80. Cooling element 16 is then activated by controller 76. The liquid water 82 disposed in lower portion 42 of cavity 32 begins to freeze due to transfer of heat "H" from the liquid water 82 into lower wall 6 and cooling element 16.

Controller 76 may also be configured to actuate one or more of the electric heating elements 44 to prevent freezing of water in the vicinity of the selected (i.e. actuated) heating elements 44. For example, the two lower most rows 44A and 44B of heating elements 44 in side wall 4B may be actuated, while the other electric heating elements 44 of ice making device 1 remain deactivated. In general, cooling element 16 will cause ice to initially form directly adjacent lower wall 6, and the ice formation will generally tend to travel upwardly as indicated by the arrows "F" (FIG. 3). However, if the two lower most rows 44A and 44B of heating elements 44 in side wall 4B are actuated, heat produced by the heating elements 44A and 44B will prevent freezing of water adjacent the actuated heating elements 44A and 44B, thereby forming a pocket or region 84 of liquid water. The outside surface 86 of the frozen water 88 will thereby tend to take on a concave shape in the region of cavity 32 directly adjacent the heating elements 44A and 44B. However, the surface 90 of the ice 88 in other regions of the cavity 32 will tend to conform to the shape of the inner surfaces 22A-22D of side walls 4A-4D, respectively.

After the water has frozen to the upper surface 80 (or other desired level), the liquid water from pocket or region 84 can be drained through fluid conduits 38 by controller 76. The frozen ice may then be removed and positioned in a bin 92 or other ice storage container or receptacle.

Figure 2:
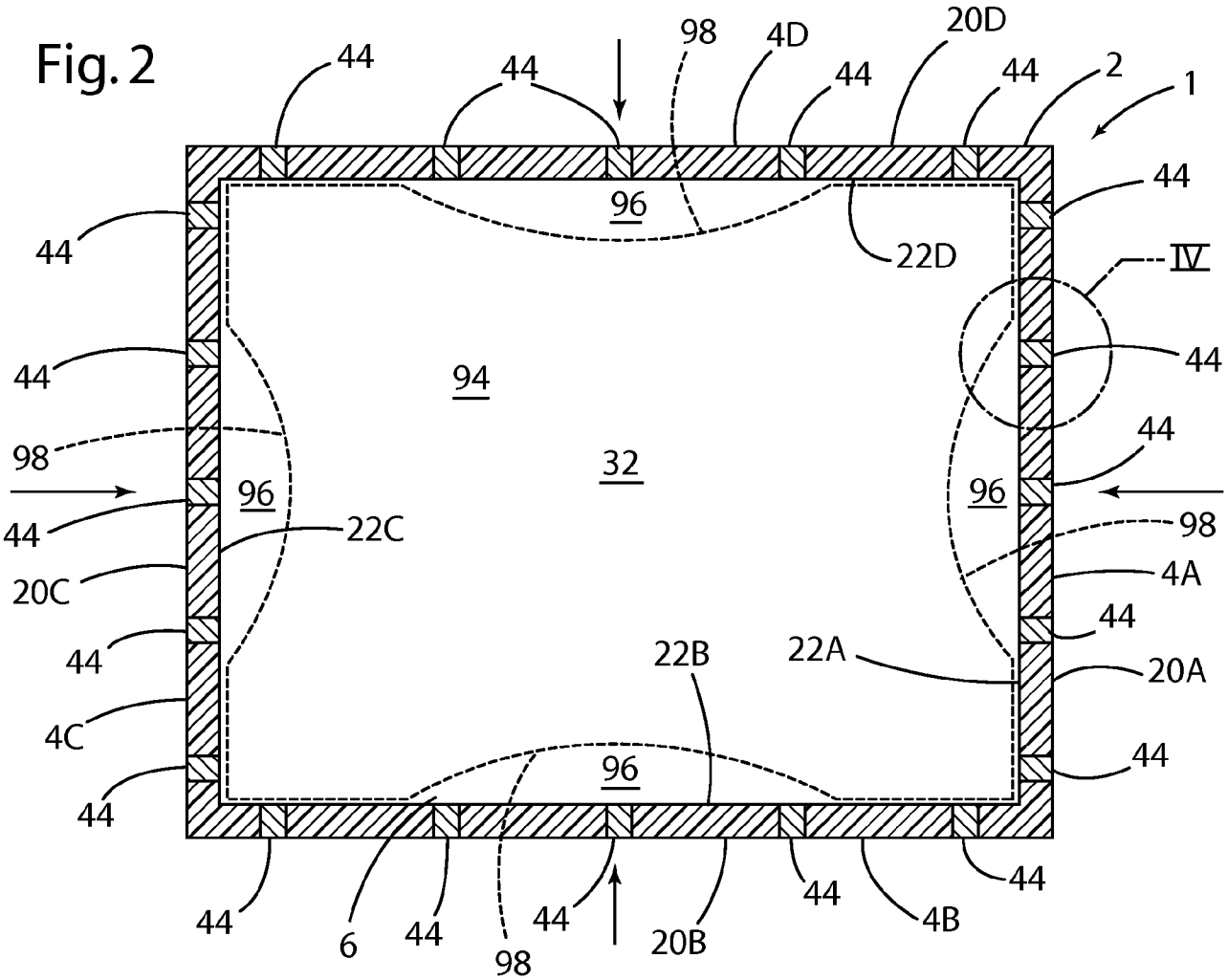
FIG. 2 is a cross sectional view of the device of FIG. 1 taken along the line II-II.

By selectively actuating certain electrical heating elements 44, the shape of the ice forming in cavity 32 can be controlled to provide different shapes. For example, with reference to FIG. 2, the three center most vertical rows of heating elements 44 may be actuated to thereby form liquid pockets 96 having a generally concave shape, such that the ice 94 formed in cavity 32 has corresponding concave surface portions 98. After ice 94 is formed to the desired shape, the remaining liquid water 96 is drained utilizing fluid conduits 38 as described above.

Controller 76 may be configured to actuate selected heating elements 44 in predefined patterns or combinations to thereby produce ice pieces or cubes having a wide variety of shapes. For example, testing can be performed to determine the effects of actuating specific individual heaters 44. Controller 76 may then be programmed to include a plurality of predefined sets of heaters 44 to be actuated at specific times to produce specific shapes. User interface 78 may be configured to provide a user with a list of ice shapes, and a user can then select an ice shape. Controller 76 then actuates cooling element 16 and selected heating elements 44 (and/or heating element 46) to produce the desired shape. In this way, a single cavity 34 can be utilized to form ice pieces or cubes having an almost unlimited number of different shapes.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A method of freezing water to form a piece of ice having a predefined shape, the method comprising:

providing a container having an inner surface defining a cavity, wherein the inner surface has a first portion and a second portion;

at least partially filling the cavity with liquid water;

cooling the first portion of the inner surface to a temperature that is below the freezing point of water to thereby cause water adjacent to the first portion of the inner surface to freeze;

heating the second portion of the inner surface to a temperature that is above the freezing point of water to thereby prevent freezing of water adjacent to the second portion of the inner surface;

freezing the liquid water to form the predefined shape by controlling cooling of the first portion of the inner surface and the heating of the second portion of the inner surface.

2. The method of claim 1, including:

draining liquid water from the cavity after at least some of the liquid water is frozen to form the predefined shape.

3. The method of claim 2, wherein:

the cavity defines a lower portion; and including:

providing a fluid conduit in fluid communication with the lower portion; and:

draining liquid water from the cavity through the fluid conduit.

4. The method of claim 3, wherein:

the liquid water is drained from the cavity after the liquid water is frozen to form the predefined shape.

5. The method of claim 1, including:

simultaneously cooling the first portion of the inner surface and heating the second portion of the inner surface.

6. The method of claim 1, wherein:

the first and second portions of the inner surface of the cavity are disposed on opposite sides of the cavity whereby ice initially forms at the first portion and grows towards the second portion as the liquid water freezes.

7. The method of claim 6, wherein:

the cavity comprises a primary cavity, and the second portion of the inner surface comprises a thermally conductive material having a mold cavity having an opening and an inner surface within the cavity formed in the second portion of the inner surface; and wherein:

freezing the water includes causing the water to freeze at the opening of the mold cavity followed by freezing of the water at the inner surface of the mold cavity.

8. The method of claim 7, wherein:

the mold cavity faces downwardly towards the primary cavity, and the first portion of the inner surface is disposed at the lower portion of the primary cavity and faces upwardly; and wherein:

liquid water in the lower portion of the primary cavity freezes first, followed by water disposed in the mold cavity.

9. The method of claim 1, including:

providing a plurality of heating elements configured to heat the second portion of the inner surface; and:

activating selected ones of the heating elements to provide uneven heating of the second surface portion to thereby control freezing of the liquid water in the vicinity of the second portion of the inner surface.

10. An ice making device, comprising:

a container having sidewalls with interior surfaces defining a cavity;

a plurality of separately controllable heating elements arranged to selectively heat spaced apart regions of the sidewalls;

a cooling element configured to cool at least a first portion of the side wall to thereby cause liquid water adjacent the first portion of the side wall to freeze;

a fluid supply conduit configured to supply liquid water to the cavity;

a fluid drain conduit configured to drain liquid water from the cavity;

a controller operably connected to the heating elements, wherein the controller is configured to actuate selected ones of the heating elements according to a selected one of a plurality of unique predefined patterns to cause water in the cavity to freeze and form a predefined ice shape corresponding to the selected one of a plurality of unique predefined patterns.

11. The ice making device of claim 10, wherein:

the container includes generally upright side walls and generally horizontal upper and lower side walls.

12. The ice making device of claim 11, wherein:

at least one heating element is disposed on the upper side wall.

13. The ice making device of claim 12, wherein:

the upper side wall includes an inner surface facing the cavity, wherein the inner surface comprises a generally concave mold cavity having a shape such that ice in the cavity forms into a generally convex shape corresponding to the shape of the mold cavity.

14. The ice making device of claim 13, wherein:

the inner surface comprises a thermally conductive.

15. The ice making device of claim 10, including:

a user interface that is configured to provide a user with a list of ice shapes whereby a user can select an ice shape.

* * * * *